US009346179B2

(12) United States Patent
Ziegler et al.

(10) Patent No.: US 9,346,179 B2
(45) Date of Patent: May 24, 2016

(54) ELECTRIC HAIR CUTTING APPARATUS

(71) Applicant: Sunbeam Products, Inc., Boca Raton, FL (US)

(72) Inventors: Andrew Ziegler, Arlington, MA (US); Alexander Tee, Arlington, MA (US)

(73) Assignee: Sunbeam Products, Inc., Boca Raton, FL (US)

( * ) Notice: Subject to any disclaimer, the term of this patent is extended or adjusted under 35 U.S.C. 154(b) by 241 days.

(21) Appl. No.: 14/356,694

(22) PCT Filed: Nov. 8, 2012

(86) PCT No.: PCT/US2012/064035

§ 371 (c)(1),
(2) Date: May 7, 2014

(87) PCT Pub. No.: WO2013/070828

PCT Pub. Date: May 16, 2013

(65) Prior Publication Data

US 2014/0310962 A1 Oct. 23, 2014

Related U.S. Application Data

(60) Provisional application No. 61/558,520, filed on Nov. 11, 2011.

(51) Int. Cl.

| | |
|---|---|
| ***B26B 19/28*** | (2006.01) |
| ***B26B 19/06*** | (2006.01) |
| ***B26B 19/38*** | (2006.01) |

(52) U.S. Cl.

CPC ..... *B26B 19/282* (2013.01); *B26B 19/06* (2013.01); *B26B 19/28* (2013.01); *B26B 19/3866* (2013.01)

(58) Field of Classification Search
None
See application file for complete search history.

(56) References Cited

U.S. PATENT DOCUMENTS

| | | | | | |
|---|---|---|---|---|---|
| 1,417,094 | A | * | 5/1922 | Monroe | B26B 19/06 30/218 |
| 1,519,601 | A | * | 12/1924 | Tomasulo | B26B 19/28 30/197 |
| 2,219,552 | A | | 10/1940 | Andis | |
| 3,411,206 | A | * | 11/1968 | Showers, Jr. | B26B 19/28 30/43.91 |
| 3,561,115 | A | * | 2/1971 | Palm | B26B 19/28 30/218 |
| 3,611,567 | A | | 10/1971 | Crane | |
| 3,863,338 | A | | 2/1975 | Wellinger et al. | |
| 5,259,116 | A | | 11/1993 | Laude | |
| 5,606,799 | A | | 3/1997 | Melton | |
| 5,678,312 | A | | 10/1997 | Watanabe | |

(Continued)

FOREIGN PATENT DOCUMENTS

| | | | |
|---|---|---|---|
| FR | 2 262 577 | * | 9/1975 |
| WO | WO 2013/070828 A1 | * | 5/2013 |

*Primary Examiner* — Hwei C Payer
(74) *Attorney, Agent, or Firm* — Seth M. Blum

(57) ABSTRACT

An electric hair cutting apparatus having a motor for rotating a shaft, which, rotates an eccentric about the axis of the shaft, but not about the central axis of the eccentric, A cylindrical bearing is positioned around the eccentric. A drive tip is provided with a follower end which is shaped and positioned to engage with the bearing surrounding the eccentric. As the eccentric rotates, the bearing alternately pushes on left and right arms of the follower end of the drive tip, causing the drive tip to oscillate back and forth about a pivot point, The angle of the bearing with respect to the eccentric allows for generally continuous contact between the arms of the follower end of the drive tip with the bearing, even throughout the pivoting of the drive tip.

14 Claims, 6 Drawing Sheets

(56) References Cited

U.S. PATENT DOCUMENTS

| | | | | |
|---|---|---|---|---|
| 5,819,415 | A | 10/1998 | Bruggers et al. | |
| 7,346,990 | B2 * | 3/2008 | Dirks | B26B 19/28 30/210 |
| 7,624,506 | B2 | 12/2009 | Melton et al. | |
| 7,748,123 | B2 | 7/2010 | Bednar | |
| 8,418,369 | B1 * | 4/2013 | Laube | B26B 19/28 30/210 |
| 8,769,824 | B2 * | 7/2014 | Heerlein | B26B 19/28 30/216 |
| 9,038,276 | B2 * | 5/2015 | Arndt | B26B 19/3866 30/208 |
| 2006/0059696 | A1 | 3/2006 | Derby et al. | |
| 2008/0034591 | A1 * | 2/2008 | Fung | B26B 19/02 30/43.92 |
| 2010/0031514 | A1 * | 2/2010 | Kohn | B26B 19/06 30/216 |
| 2010/0229396 | A1 | 9/2010 | Bednar | |
| 2014/0310962 | A1 * | 10/2014 | Ziegler | B26B 19/06 30/216 |

* cited by examiner

ELECTRIC HAIR CUTTING APPARATUS

FIELD OF THE INVENTION

The present invention relates to an electric hair cutting apparatus and, more particularly, to an apparatus including a bearing angled with respect to the eccentric on which it resides, to maintain flush contact with the follower surface of the drive tip.

BACKGROUND OF THE INVENTION

In general, an electric hair cutting apparatus includes a fixed primary blade and a secondary reciprocating blade. A motor causes the reciprocating blade to move side-to-side with respect to the fixed blade, trimming any hair therebetween. Often, an eccentric is used to translate straight-line rotation created by the motor into the side-to-side motion needed to move the reciprocating blade. A shaft from the motor, which rotates about its central longitudinal axis, is generally connected to the eccentric. In some constructions, the shaft is connected to the eccentric at a position which is off-center from the central axis of the eccentric, such that rotation of the shaft causes the eccentric to revolve around an axis other than the central axis of the eccentric. This off-center rotation of the eccentric can be used to induce side-to-side motion of the reciprocating blade.

However, mechanically translating the rotational motion of the eccentric into side-to-side motion generally involves physically contacting the eccentric (or a flange extending from the eccentric) with another component, such as a drive tip, which drives the reciprocating blade. As the eccentric rotates, it physically pushes on the drive tip, creating a point of wear. Further, maintaining proper contact between the eccentric and the drive tip can be somewhat difficult. The wear and tear, as well as loose hair build-up can cause inefficient or ineffective contact with the eccentric.

Further, as the eccentric rotates, it inherently creates a moving center of mass for the clippers. This is felt as a vibration to the user, due to the high RPM at which the eccentric is rotating. Such vibration is undesirable to users.

It is therefore desirable to provide a hair cutting apparatus with less wear and tear on the internal components, and which exhibits less vibration during use.

SUMMARY OF THE INVENTION

The present invention includes an electric hair cutting apparatus including an angled eccentric bearing. In one embodiment, a shaft extends from a motor, and interfaces with an eccentric off-center from the central axis of the eccentric. As the motor causes the shaft to rotate, the shaft in turn causes the eccentric to rotate about the axis of the shaft, but not about the central axis of the eccentric. A cylindrical bearing is positioned around the eccentric such that the central axis of the bearing is at a slight angle with respect to the central axis of the eccentric. A drive tip is provided with a follower end and a blade end and pivot point therebetween. The follower end of the drive tip is shaped and positioned to engage with the bearing surrounding the eccentric. As the eccentric rotates, the bearing alternately pushes on the left and right arms of the follower end of the drive tip, causing the drive tip to oscillate back and forth about the pivot point. The angle of the bearing allows for generally continuous contact between the arms of the follower end of the drive tip with the bearing, even throughout the pivoting of the drive tip. The pivoting motion of the drive tip causes its other end—the blade end of the drive tip, to oscillate back and forth as well. The blade end of the drive tip is connected to the reciprocating blade, which causes the reciprocating blade to oscillate back and forth as well.

Additionally, the moving parts of the apparatus are preferably supported by a front motor housing. By positioning dampers between the external housing of the apparatus and the front motor housing, much of the vibration caused by the movement of the eccentric, blades, etc., can be reduced before it reaches the housing and the user. By supporting substantially all of these components with the front motor housing, none of the moving components interact the external housing directly. Thereby, the additional dampers are able to act upon substantially all vibrations caused by such components.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
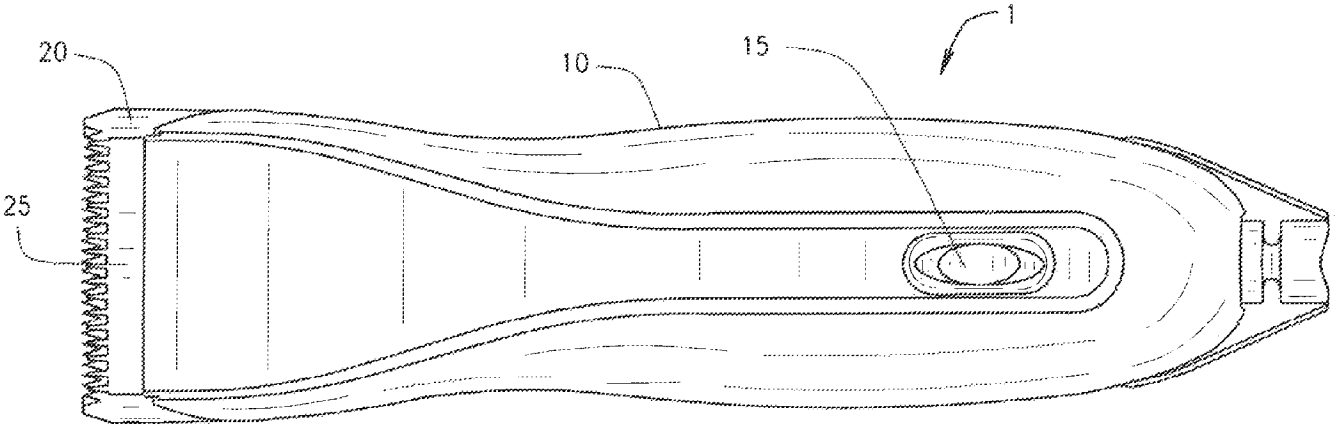
FIG. 1 is a front elevation view of electric hair clippers according to an embodiment of the present invention.

Referring now to the drawings and, more particularly, to FIG. 1, a front elevation view of an electric hair cutting apparatus 1 according to the teachings of the present invention is shown. Electric hair cutting apparatus 1 includes a housing 10 which is generally hollow and houses the internal workings of the apparatus 1. A manual switch 15 is provided for turning the apparatus 1 on and off. The switch 15 may also include various speed settings. At one end of the apparatus 1 are the fixed blade 20 and the reciprocating blade 25, as is known in the art. The reciprocating blade 25 oscillates back and forth, left and right, so as to cut hair which enters between the teeth of the blades 20, 25.

Figure 2:
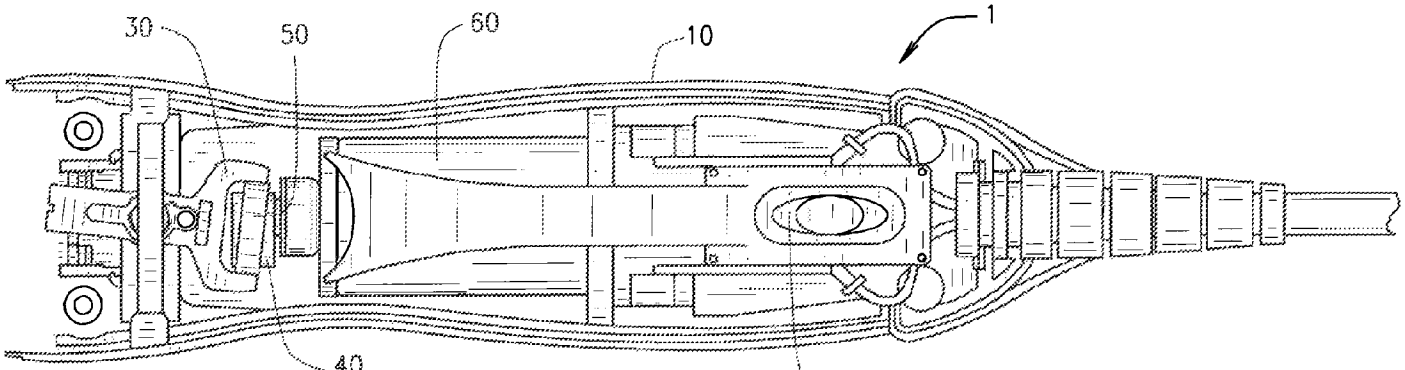
FIG. 2 is a front elevation view of the electric hair clippers of FIG. 1, with the front portion of the outer housing removed.

FIG. 2 is a front elevation view similar to FIG. 1, but with one side of housing 10 removed for better viewing of the internal workings of the apparatus 1. As can be seen, housing 10 houses a drive tip 30, which interacts with a bearing 50 around an eccentric 40. The eccentric 40 is mechanically connected to a motor 60 by shaft 45, such that motor 60 causes the eccentric 40 to rotate via shaft 45. Actuation of switch 15 allows electricity to flow into and power the motor 60, which, through a series of events and mechanisms described hereinbelow, causes the reciprocating blade 25 to oscillate relate to the fixed blade 20.

Figure 3:
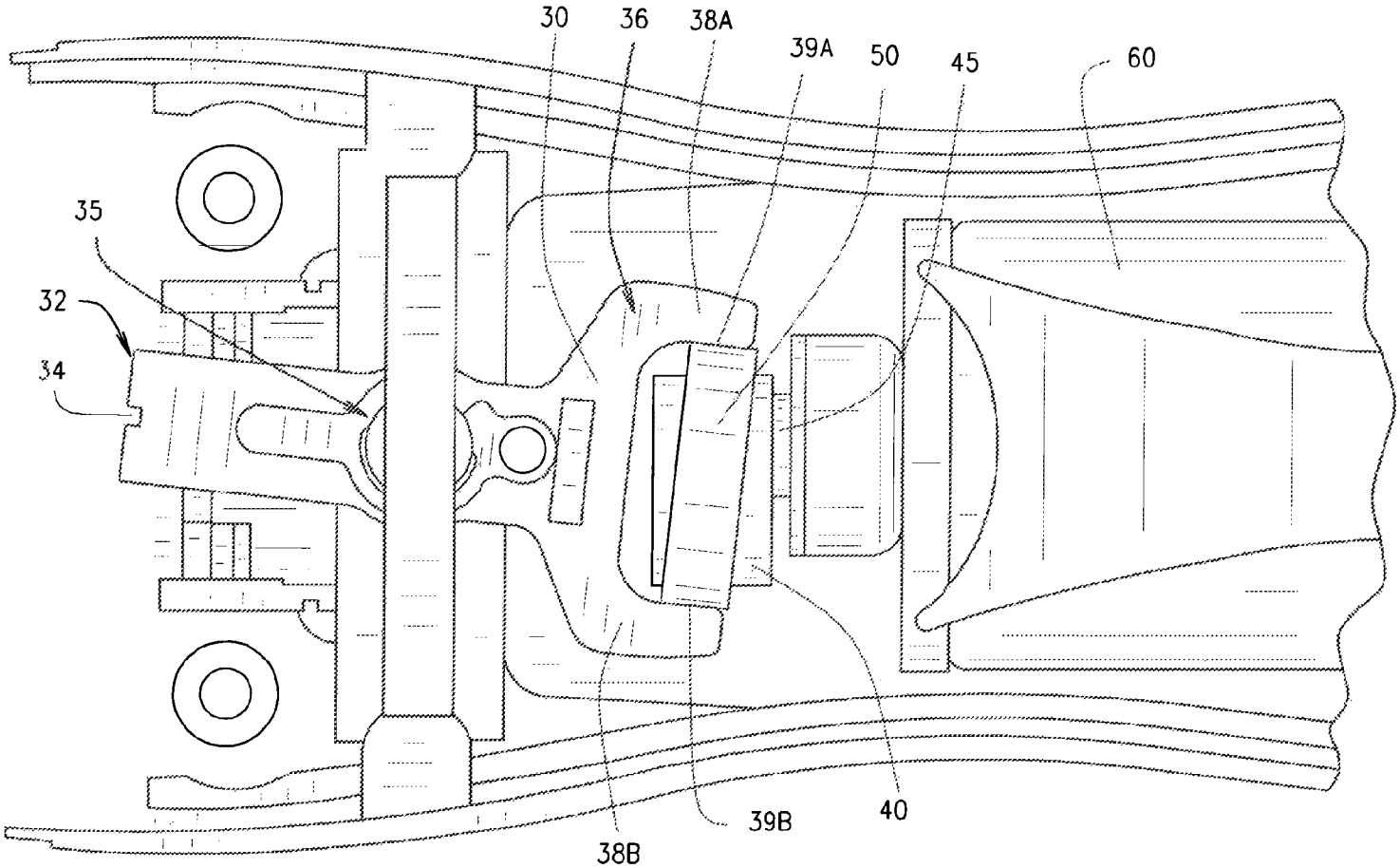
FIG. 3 is a close-up view of the drive tip and eccentric of FIG. 2.

As can be seen in FIG. 3, the drive tip 30 has two ends—a blade end 32 and a follower end 36—separated by a pivot point 35. The blade end 32 includes a groove 34 for accepting a flange connected to the reciprocating blade 25. Thereby, movement of the blade end 32 of the drive tip 30 causes movement of the reciprocating blade 25. The follower end 36 of the drive tip 30 includes left and right arms 38A, 38B with respective internal follower surfaces 39A, 39B. The arms 38A, 38B extend from the drive tip 30 on opposing sides of the eccentric 40 and bearing 50. Follower surfaces 39A, 39B of arms 38A, 38B may stay generally in continuous contact with the bearing 50 as it rotates.

Figure 4A:
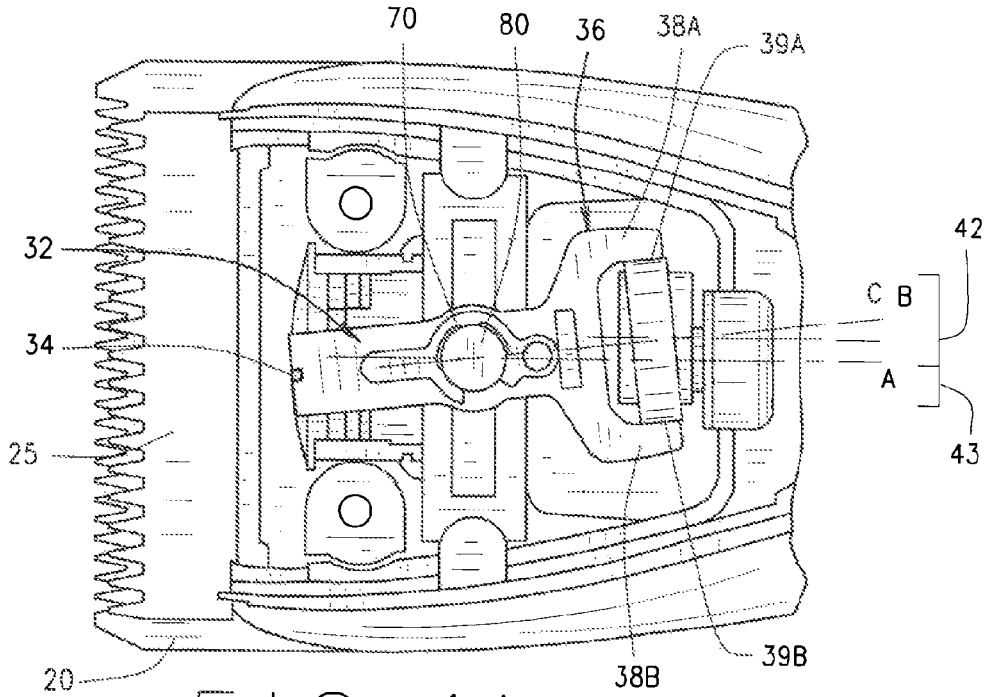
FIG. 4A is a close-up view of a drive tip with the pivot shaft exposed, with the drive tip and eccentric in a first position.
Figure 4B:
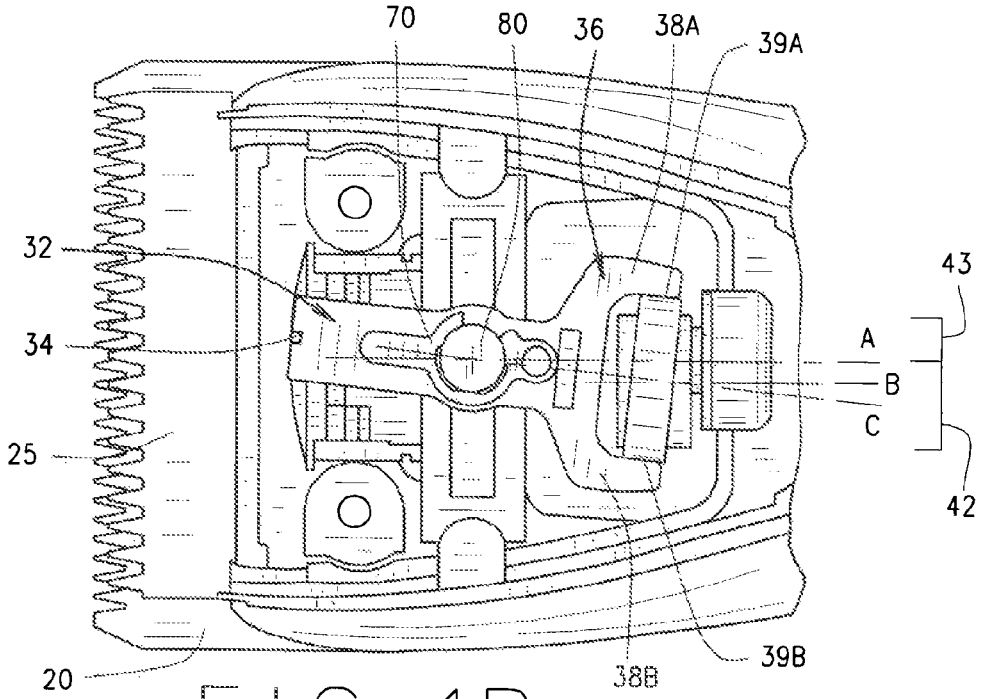
FIG. 4B is a close-up view of a drive tip with the pivot shaft exposed, with the drive tip and eccentric in a second position.

As can be seen in FIGS. 4A and 4B, shaft 45 extends from motor 60 to eccentric 40, but does not connect to eccentric 40 at the central axis B of eccentric 40. Rather, shaft 45 connects to eccentric 40 off center, such that eccentric 40 rotates about the longitudinal axis A of shaft 45 but not central axis B of eccentric 40. Thus, the shaft 45 divides the eccentric 40 into a major portion 42 which extends ftom the center of rotation A to the farthest edge of the bearing 50, and a minor portion 43 which extends from the center of rotation A to the nearest edge of the bearing 50, as shown in FIG. 4A.

Thus, as the shaft 45 causes the eccentric 40 and bearing 50 to rotate about axis A, the anus 38A, 38B follow the movement of the eccentric 40 and bearing 50. For example, in FIG. 4A, the major portion 42 is positioned toward the left arm 38A, such that the drive tip 30 has pivoted toward the left arm 38A. Similarly, in FIG. 4B, the major portion 42 has rotated so as to be positioned toward the right arm 38B, such that the drive tip 30 has oscillated and pivoted toward the right arm 38B. The drive tip 30 is thereby caused to pivot about the pivot point 35 by the rotation of the eccentric 40 and bearing 50 about axis A.

Additionally, the bearing 50 is preferably positioned on the eccentric 40 at an angle such that the central bearing axis C passes generally through the pivot point 35, As will be understood, when the drive tip 30 pivots about the pivot point 35, the angle of the arms 38A, 38B changes relative to the axis of rotation A of the shaft 45. Angling the bearing 50 so that its central axis C passes through the pivot point 35 causes the bearing 50 to remain perpendicular to the longitudinal axis of the drive tip 30 throughout oscillation of the drive tip 30 and rotation of the eccentric 40 and bearing 50. This allows the follower surfaces 39A, 39B of arms 38A, 38B to remain parallel with the side wails of the bearing 50, for better contact and less wear therebetween.

Without angling the bearing 50 on the eccentric 40, the bearing 50 would not remain perpendicular to the drive tip 30 as the drive tip 30 oscillates. In such a situation, the follower surfaces 39A, 39B of arms 38A, 38B would be flush with the side-walls of the bearing 50 only when the longitudinal axis of the drive tip 30 is parallel with the axis of rotation B of the eccentric 40. When the drive tip 30 is not in line with this axis B, the follower surfaces 39A, 39B of arms 38A, 38B would not make flush contact the bearing 50, and instead would contact the bearing 50 at a relatively small point. This minimal contact would increase loading and wear at the small contact point, and reduces wear to avoid or delay the onset of excessive wear opening the cap between the parts, and a decrease in sweep of the drive tip 30. Similarly, angling the bearing 50 is preferably to curving the outer surface of the bearing 50 for similar reasons—the loading and wear at the point of contact would be higher than desired.

Bearing 50 may be removable from eccentric 40 for easy replacement, or may be integral with eccentric 40 such that replacement requires replacing the eccentric 40 as well. The bearing 50 is flushingly mounted about the eccentric 40 so as to prevent hair build-up between the hearing 50 and the eccentric 40. Additionally, a weight could be added to the eccentric to counterbalance the mass of the reciprocating blade 25 to reduce vibration. However, it should he understood that increasing the weight of the eccentric 40 will also create a greater load on motor 60. Similarly, weight may he added to the follower end 36 of the drive tip 30 to counterbalance the mass of the reciprocating blade 25 to reduce vibration. Again, however, adding such weight would create a greater load on motor 60. As such, the weight of the eccentric 40 and/or drive tip 30 may be user adjustable, either by replacing these components with lighter or heavier components as desired, or by physically adding weights to existing components as desired.

Figure 5:
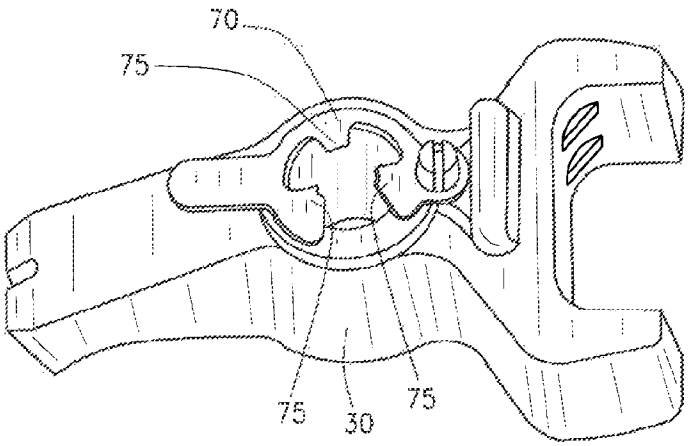
FIG. 5 is a perspective view of a drive tip.

In this regard, drive tip 30 may be structured and adapted for tool-less removal. In one embodiment as shown in FIGS. 4A and 4B, the drive tip 30 pivots about a pivot shaft 80. As can he better seen in FIG. 5, a drive tip retainer 70 is attached to the drive tip 30. Projections 75 extend into the hollow column of the drive tip 30 through which the pivot shaft 80 extends. When installed, the projections 75 snap into a groove in the pivot shaft 80, allowing the user to remove the drive tip 30 without tools. Alternatively, the drive tip may he secured in place by a screw or the like. Preferably, the drive tip 30 is concentric in shape, and may be sized and shape to be used in a range of blade drive pockets of various hair clippers.

The drive tip 30 can include a relief cut, living hinge, which allows the drive tip 30 to be fit snugly into a range of blade drive pockets. The relief cut in the drive tip 30 allows for fitting in a large sized drive pocket without deflection of a portion of the drive tip 30, and for fitting a small size drive pocket by a deflection in at least a portion of the drive tip 30. The snug fit of the drive tip 30 in the blade drive pocket reduces the noise and vibration produced therein.

Figure 6:
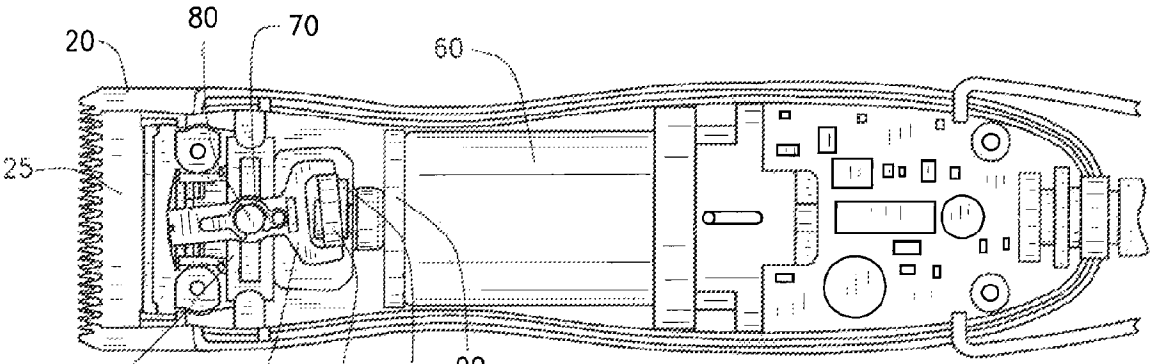
FIG. 6 is another front elevation view of electric hair clippers, with the front portion of the outer housing removed.

Apparatus 1 may also include a front motor housing 90. Front motor housing 90 houses or is attached to the motor 60. In one embodiment, as shown in FIG. 6, front motor housing 90 supports the drive mechanisms of the apparatus 1. Front motor housing 90 may include pivot shaft 80, or pivot shaft 80 may be attached to front motor housing 90. The pivot shah 80 may be further reinforced by a cross bar 85, which may also be a part of or attached to the front motor housing 90. By using the front motor housing 90 as the support mechanism for the pivot drive mechanism discussed above, the tolerance loop is shortened, allowing for a tighter fitting mechanism with better wear properties for its components and better overall quality.

The front motor housing 90 may be made of zinc, or another suitably strong metal. Additionally, zinc is preferred because of its weight. Weight, along with sweep and speed are the three main factors that significantly affect vibration. Placing much of the weight of the apparatus 1 close to blades 20, 25 via the front motor housing 90, vibration can be greatly reduced. The metal front motor housing 90 also helps to dissipate heat out from the apparatus 1. Some prior art hair clippers have attempted to vent heat down the sides of the clipper, but have had problems with hair entrapment, excess noise and an unwanted breeze. Without any heat dissipation, the clipper will maintain a higher temperature and have a shorter life. Thus, the metal front motor housing 90 helps to dissipate the heat, and any exposed surface of the front motor housing 90 may be ribbed to increase surface area. Such a design further allows for the apparatus 1 to be sealed from contamination. A sealed housing 10 reduced hair entrapment. Such seals can be made by foam (where moving parts are to be sealed) and/or with elastomeric features.

Figure 7A:
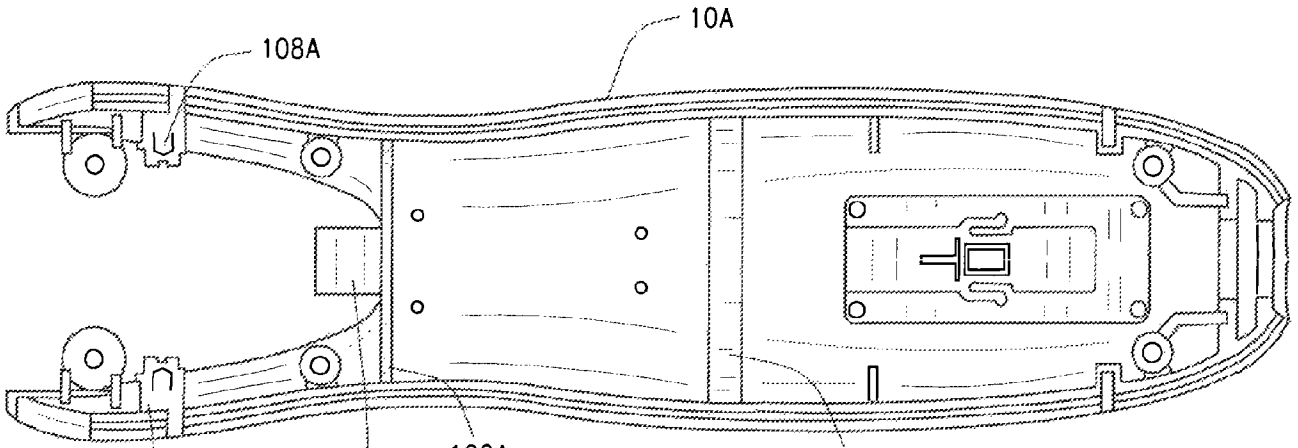
FIG. 7A is an internal view of the front portion of an outer housing.
Figure 7B:
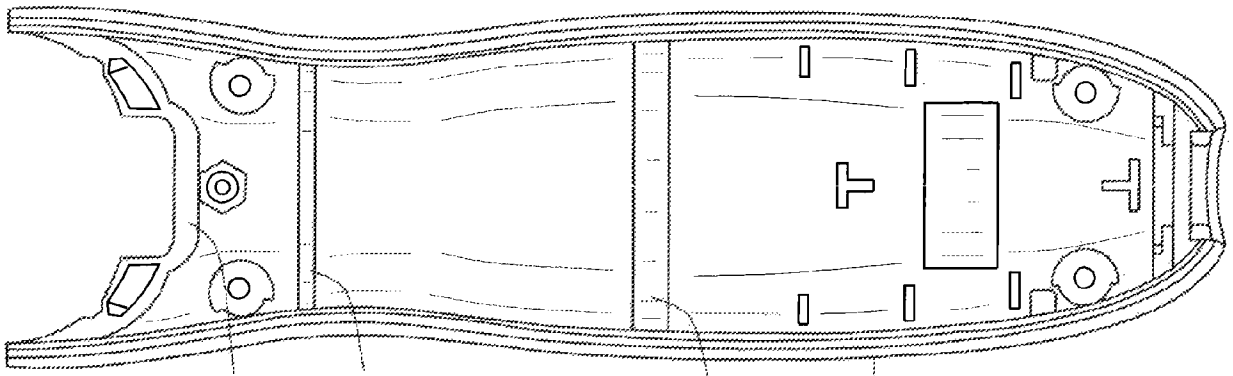
FIG. 7B is an internal view of the back portion of an outer housing.

Thus, as can be seen in FIG. 6, the clipping core (comprised of the motor 60, front motor housing 90 and the pivot drive mechanism) is preferably a self-contained unit. By installing various damping and vibration isolation structures, the clipping core can be largely isolated and decoupled from the housing 10 with respect to heat and vibrations. FIGS. 7A and 7B, which illustrate front and back portions 10A, 10B of housing 10. As can be seen in FIG. 7A, the front portion 10A includes isolation mounts 100A and 102A. As can be seen in FIG. 7B, the back portion 10B includes isolation mounts 100B, 102B and 104B. Preferably, each of the isolation mounts is made of a material which dampens vibrations and/or heat. As shown in FIGS. 7A and 7B, the isolation mounts take the form of elastomeric ribs, though other structures are contemplated. In one embodiment, the isolation mounts may be formed in an overmolding process. However, in other embodiments, separate parts may be used to serve as the isolation mounts, which would allow for changing the properties of the mounts in terms of shape and durometer to optimize the system and minimize vibration.

Additionally, as shown in FIG. 7A, additional dampers 106A, 108A and 110A may also be used to isolate the hood 112 drive mechanism and blades 20, 25. Such dampers 106A, 108A and 110A are preferably elastomeric pads which are proud of the housing 10. Additionally, a foam seal may preload the front portion 10A of the housing 10, thereby reducing the chances for vibration.

Figure 8A:
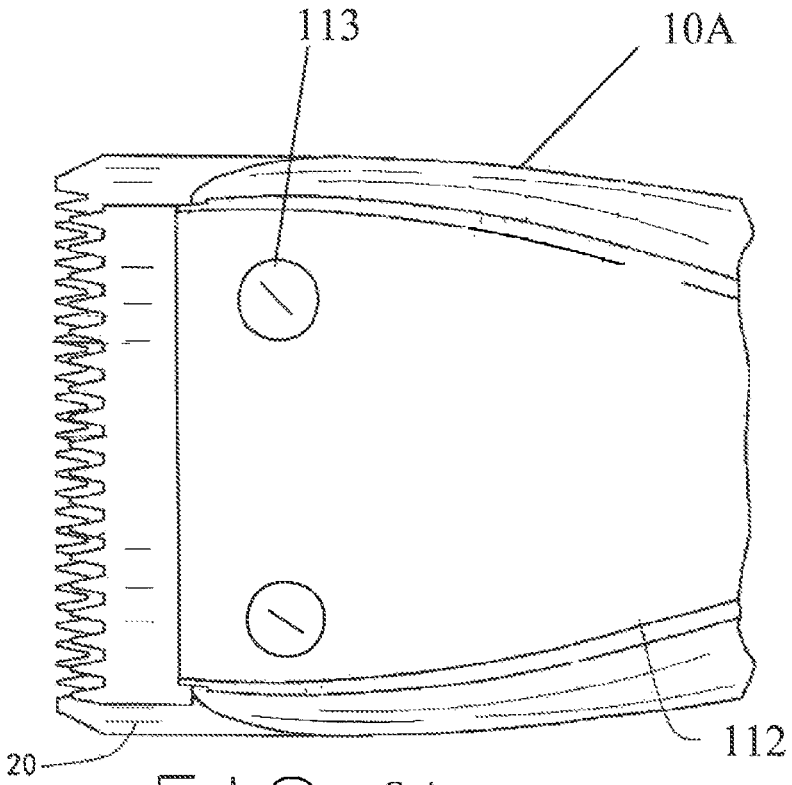
FIG. 8A is a top view of a hood connected to the housing.
Figure 8B:
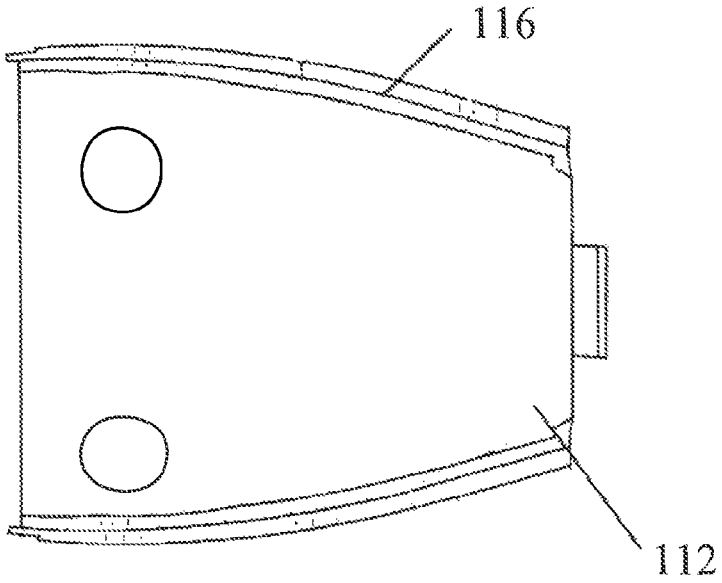
FIG. 8B is a bottom view of the hood.

Referring to FIGS. 8A and 8B, the hood 112 is affixed to the front portion 10A of the housing 10, covering at least the drive tip 30, bearing 50 and eccentric 40. The hood 112 can be connected to the housing with attachment members 113, such as screws. The hood 112 can includes a foam seal 116 about its periphery, which can preload the hood 112 against the front portion 10A of the housing 10 to prevent or reduce the vibration of the hood 112 against the front portion 10A of the housing 10.

Thus, there has been shown and described several embodiments of an electric hair cutting apparatus. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A clipping apparatus comprising:

a reciprocating blade;

a motor;

a shaft mechanically connected at one end to the motor for being driven to rotate by the motor;

an eccentric connected off-center to another end of the shaft, such that rotation of the shaft causes the eccentric to rotate about a longitudinal axis of the shaft, but not about a central axis of the eccentric;

a bearing connected to the eccentric;

a drive tip having a first end, a pivot point and a second end, wherein the second end engages with the reciprocating blade, and wherein the drive tip pivots about the pivot point, and wherein the first end is sized and shaped to follow the bearing and the eccentric such that rotation of the eccentric and the bearing causes the first end of the drive tip to oscillate back and forth causing the drive tip to pivot about the pivot point, thereby causing the second end to oscillate and drive the reciprocating blade;

and wherein the bearing is positioned on the eccentric such that a central axis of the bearing intersects with the pivot point of the drive tip throughout the range of motion of the bearing and the eccentric.

2. The clipping apparatus of claim 1 wherein a counterbalance weight is added to the eccentric.

3. The clipping apparatus of claim 1 wherein a counterbalance weight is added to the first end of the drive tip.

4. The clipping apparatus of claim 1 wherein the bearing is removable from the eccentric for repair or replacement.

5. The clipping apparatus of claim 1 wherein the bearing is integral with the eccentric.

6. The clipping apparatus of claim 1 Wherein the drive tip further includes a drive tip retainer which selectively snaps into a groove in a pivot shaft about which the drive tip pivots to hold the drive tip in place during use.

7. The clipping apparatus of claim 1 further including a front motor housing which supports at least the motor, the shaft, the eccentric, the bearing and the drive tip.

8. The clipping apparatus of claim 7 further including at least one isolation mount for damping at least one of vibration and heat between the front motor housing and an outer housing of the clipping apparatus.

9. A clipping apparatus comprising:

a front motor housing;

a motor supported by the front motor housing;

a shaft mechanically connected at one end to the motor for being driven to rotate by the motor;

a pivot post supported by the front motor housing;

an eccentric connected off-center to another end of the shaft;

a bearing connected to the eccentric at an angle such that a central axis of the bearing intersects with the pivot post;

a drive tip having a first end, a pivot point and a second end, wherein the second end engages with a reciprocating blade, and wherein the drive tip engages with and is supported by the pivot post so as to pivot about the pivot point, and wherein the first end is sized and shaped to follow the bearing and the eccentric during rotation thereof;

a housing; and isolation mounts positioned between the front motor housing and the housing.

10. The clipping apparatus of claim 9 wherein a counterbalance weight is added to the eccentric.

11. The clipping apparatus of claim 9 wherein a counterbalance weight is added to the first end of the drive tip.

12. The clipping apparatus of claim 9 wherein the bearing is removable from the eccentric for repair or replacement.

13. The clipping apparatus of claim 9 Wherein the bearing is integral with the eccentric.

14. The clipping apparatus of claim 9 wherein the drive tip further includes a drive tip retainer which selectively snaps into a groove in the pivot post to hold the drive tip in place during use.

* * * * *